US005725034A

United States Patent [19]

Fry et al.

[11] Patent Number: 5,725,034

[45] Date of Patent: Mar. 10, 1998

[54] PRESSURIZED FLUID DISPENSING NOZZLE

[75] Inventors: David Andrew Fry, St. Kilda; David Richard Brooks, Boronia Park, both of Australia

[73] Assignee: Gogas (Australia) Pty. Ltd., Victoria, Australia

[21] Appl. No.: 549,778

[22] PCT Filed: May 13, 1994

[86] PCT No.: PCT/AU94/00248

§ 371 Date: Apr. 10, 1996

§ 102(e) Date: Apr. 10, 1996

[87] PCT Pub. No.: WO94/18818

PCT Pub. Date: Sep. 1, 1994

[30] Foreign Application Priority Data

May 14, 1993 [AU] Australia ..... PL 8814
Oct. 28, 1993 [AU] Australia ..... PM 2101

[51] Int. Cl.[6] ..... B67D 5/37

[52] U.S. Cl. ..... 141/347; 141/287; 141/352; 141/354; 141/384

[58] Field of Search ..... 141/346, 347, 141/351–355, 382–384, 387, 392

[56] References Cited

U.S. PATENT DOCUMENTS

| | | | |
|---|---|---|---|
| 2,096,499 | 10/1937 | Mandell | 141/353 X |
| 3,086,565 | 4/1963 | Mosher | 141/347 |
| 3,422,864 | 1/1969 | Allinquant | 141/347 |
| 3,805,857 | 4/1974 | Johnson et al. | 141/287 |
| 4,907,630 | 3/1990 | Kulikowski et al. | 141/384 |
| 4,967,999 | 11/1990 | Otsuki et al. | 251/149.7 |

FOREIGN PATENT DOCUMENTS

| | | |
|---|---|---|
| 118269 | 3/1944 | Australia . |
| 119865 | 5/1945 | Australia . |
| 234570 | 1/1960 | Australia . |
| A1-70265/81 | 11/1981 | Australia . |
| B-71482/87 | 10/1987 | Australia . |
| A-80239/91 | 1/1992 | Australia . |
| 039977 | 11/1981 | European Pat. Off. . |
| 1013131 | 8/1957 | Germany . |
| 1072025 | 6/1960 | Germany . |
| WO 88/01601 | 3/1988 | WIPO . |
| WO 91/13023 | 9/1991 | WIPO . |
| WO 92/07165 | 4/1992 | WIPO . |
| WO 95/02554 | 1/1995 | WIPO . |

*Primary Examiner*—J. Casimer Jacyna
*Attorney, Agent, or Firm*—Hoffmann & Baron, LLP

[57] ABSTRACT

A pressurized fluid dispensing nozzle (110') such as for LPG is screw-threadedly engageable with a tank inlet (192) such as on a vehicle. A sealing sleeve (154) carrying a nose piece (140') is biassed into abutment with a gasket (194) on a seal face (196) of the tank inlet and is urged rearwardly by the abutment. The sealing sleeve (154) is slidably mounted on a sealing member (136') which is urged rearwardly with the sealing sleeve (154) into a valve actuating condition. A trigger (118') is actuated to open a valve assembly (120') by shifting the valve assembly forwardly to bring a valve body (126') into abutment with an actuator (132') on the sealing member (136) which lifts the valve body off a valve seat (128'). The pressurized fluid passes along a passage (146') through the sealing member (136') to be dispensed but part of it enters a chamber (150) through ports (134'). The pressurized fluid in the chamber (150) acts on the sealing sleeve (154) to drive it into sealing engagement with the tank inlet gasket (194) or, if the gasket is missing, with the seal face (196).

33 Claims, 4 Drawing Sheets

PRESSURIZED FLUID DISPENSING NOZZLE

BACKGROUND OF THE INVENTION

The present invention relates to a pressurized fluid dispensing nozzle and is particularly, but not only, concerned with such a nozzle suitable for dispensing liquid petroleum gas (LPG).

There have been many proposals for coupling an LPG dispensing nozzle to a tank inlet. In all of these, when the nozzle is coupled to the tank inlet, for example by a screw-threaded cooperation, a seal needs to be formed between the outlet end of the nozzle and the trunk inlet. One such proposal is described in Australian Patent Specification AU-A-79191/87 in which a sealing nose-piece is slidably disposed within the outlet end portion of the nozzle and is spring biased to engage the tank inlet as the nozzle is screw-threadedly connected to the inlet. In practice only a one-half turn is required to fully engage the nozzle with the tank inlet. Usually the nose-piece engages a rubber face seal or other gasket associated with the tank inlet, but commonly this gasket is missing from the vehicle. This means that a less reliable seal may be formed between the nose-piece and tank inlet since the nose-piece may be able to be displaced rearwardly relative to the remainder of the nozzle by the pressure of the LPG as it is dispensed from the nozzle. Similar problems may arise if the screw-threaded connector of the nozzle is not fully tightened onto the tank inlet, for example because of a cross-threaded engagement, or becomes loose during use.

OBJECT AND SUMMARY OF THE INVENTION

It is an object of the present invention to alleviate the aforementioned disadvantages and there is accordingly provided a pressurized fluid dispensing nozzle comprising a connector for coupling the nozzle to a tank inlet, a valve for controlling the dispensing flow of fluid through the nozzle in a forward generally axial direction and a sealing nose-piece which is engageable with a seal face of the tank inlet for providing a seal between the nozzle and the tank inlet when the nozzle is coupled to the tank inlet, the sealing nose-piece being provided on a sealing sleeve through which the fluid is dispensed to an outlet end of the nozzle defined by said nose-piece, the sealing sleeve being axially displaceable in opposed directions relative to the connector, and wherein axial displacement of the sealing sleeve in the forward direction is actuated by the dispensing flow of pressurized fluid through the nozzle when the valve is open whereby when the nozzle is coupled to the tank inlet the nose-piece is driven by the pressurized fluid into engagement with said seal face.

The sealing sleeve is conveniently mounted for limited axial displacement on a seal member having a passage extending generally axially therethrough through which the dispensing flow of fluid passes to the outlet end of the nozzle. The seal member may also be axially displaceable relative to the connector, but the rearwards axial displacement of the seal member should be restricted in order to ensure an adequate seal can be maintained by the nose-piece. The seal member may incorporate a rearwardly-projecting actuator for opening the valve.

Further according to a preferred embodiment of the present invention there is provided a pressurized fluid dispensing nozzle comprising a connector for coupling the nozzle to a tank inlet, a valve for controlling the dispensing flow of fluid through the nozzle in a forward generally axial direction a sealing nose-piece which is engageable with a seal face of the tank inlet for providing a seal between the nozzle and the tank inlet when the nozzle is coupled to the tank inlet, and a seal member which is permitted limited axial displacement relative to the connector, the seal member having a passage therethrough for the dispensing flow of fluid and further comprising a rearwardly projecting actuator for opening the valve, the seal member being displaced rearwardly towards a valve actuating condition by engagement of the nose-piece with the seal face of the tank inlet, and wherein the nose-piece is provided on a sealing sleeve which is mounted for limited axial sliding movement on the seal member, axial movement of the sealing sleeve in a forward direction being actuated by the dispensing flow of pressurized fluid through the nozzle when the valve is open whereby when the nozzle is coupled to the tank inlet the nose-piece is driven by the pressurized fluid into engagement with the seal face.

By this embodiment of the invention, a seal can be ensured between the nozzle and tank inlet whether or not a gasket is provided on the seal face of the tank inlet while still permitting full flow of the pressurized fluid through the nozzle. Thus, the pressurized fluid ensures not only that the nosepiece is displaced forwardly sufficiently to make a seal with the seal face of the tank inlet even if the normal gasket is not present, or if the nozzle is not properly connected to the tank inlet, but also that the seal member can be displaced sufficiently rearwardly that the nozzle can be fully opened.

The sealing sleeve may advantageously be biased in the forward direction by, for example a compression spring, to apply a pre-load to the sliding sleeve and create at least a partial seal with the tank inlet before the pressurized fluid valve means is opened. In the embodiment incorporating the seal member, the pressurized fluid for actuating the sealing sleeve may be supplied to a chamber defined between the sliding sleeve and seal member, conveniently from the passage through the seal member or from between the sliding sleeve and seal member, and the sliding sleeve biasing device may be disposed in this chamber. However, whether or not the biasing device is provided, the actuating fluid pressure most advantageously applies a driving force to the sealing sleeve so that the sleeve is sealingly engaged with the tank inlet when the fluid pressure reaches the nose-piece and the outlet end of the nozzle. This reduces the possibility of fluid pressure lifting the tank inlet face seal or other gasket from its mounting surface and allowing a leak path to develop before sealing is achieved.

Most advantageously, the fluid pressure is applied to an actuating surface of the sealing sleeve of greater area than that of the nose-piece in order to ensure that a sealing force is always applied to the sealing sleeve under constant fluid pressure.

Conveniently the nose-piece is resilient and may be moulded in, for example. polyurethane or thermoplastic polyester.

Although the preferred arrangement of the nozzle will vary according to the particular shape of the tank inlet, it is most preferred that the outlet end of the nozzle as defined by the nose-piece is substantially flush with the corresponding end of the connector when the sealing sleeve is at its forwardmost position and the seal member, if provided, is at its rearwardmost position.

Preferably, the connector is screw-threadedly engageable with the tank inlet, most preferably by an acme thread. Most advantageously, the screw-threaded engagement is such that about one to two complete rotations, preferably one and a half to two rotations, of the connector are required to fully engage the nozzle on the tank inlet However, it will be appreciated that the invention is also effective with other types of connector well known in different parts of the world.

When the connector is screw-threadedly engageable with the tank inlet, part of the tank inlet will be received between the connector and the sealing sleeve, and it is preferred that an outer diameter of the sealing sleeve is sufficiently smaller than an inner diameter of the tank inlet that the tank inlet will not bind the sealing sleeve even in the event of a cross-threaded engagement.

In one embodiment of the pressurized fluid dispensing nozzle, which is described generally immediately hereinafter, the valve comprises an annular valve seat and a valve body axially displaceable relative to the seat, the actuator is capable of abutting the valve body to open the valve, the passage through the seal member extends through the actuator and an operating device such as a lever or trigger is provided for opening the valve by displacing the valve into a position in which the actuator is adapted to abut the valve body.

One of the problems of this type of nozzle using trigger operation is the trigger force, that is the manual force which must be applied to the trigger lever in order to fully open the valve. The aforementioned AU-A-79191/87 has a complicated valve system in which the valve body forms part of a dashpot system for releasing the pressure. However, pressure is only released from the dashpot system once the valve has been initially opened to then facilitate further opening of the valve.

It has now been appreciated that the trigger force can be more simply and effectively reduced by reducing the diameter of the valve seat. However, this is not readily feasible with the nozzle described in AU-A-79191/87 since in the open condition of the valve the actuator projects through the annular valve seat and the actuator is a close fit within the valve seat.

This problem may be alleviated in said one embodiment of the nozzle by providing an abutment face of the actuator for engagement with the valve body which is substantially co-axial with the valve seat and is closed to the passage and by arranging that the passage opens through a wall of the actuator adjacent said abutment face. Thus, the abutment face can be defined by an at least substantially solid end of the actuator. Since it is no longer annular and therefore defined by the diameter of the passage through the actuator, the abutment face may be of considerably smaller external diameter than is possible in AU-A-79191/87. This permits the corresponding abutment surface of the valve body have at least substantially equally small external dimension which itself enables the diameter of the valve seat to be reduced.

In order to maintain the desired dispensing flow of fluid through the passage in the actuator, it is preferred to have plural openings thereof adjacent the abutment face, and most advantageously the or each face of the actuator wall through which the passage opens adjacent the abutment face tapers towards the abutment face. Effectively therefore, the abutment face may be provided on a reduced diameter tail portion of the actuator which projects rewardly from the remainder of the actuator.

It is not necessary that the actuator projects through the valve seat in the open condition of the valve and the valve body may incorporate a forwardly projecting nose for engagement with the abutment face and which itself projects through the valve seat. Thus, dispensing flow of fluid through the open valve is around the nose, and preferably the engaging surface of the nose has substantially the same external dimension as the abutment face.

Alternatively, instead of providing the closed abutment face on the actuator, in the one embodiment of the nozzle, the same advantage of being able to reduce the diameter of the valve seat can be achieved by providing the valve body with a nose for engagement with the actuator which nose projects forwardly of the valve seat in both the open and closed conditions of the valve and wherein the portion of the nose which is displaceable through the valve seat has a cross-sectional area smaller than the valve seat to permit the dispensing flow of fluid through the valve seat. In this arrangement, the abutment face of the actuator may be annular, in which case the engagement face of the valve body may be suitably enlarged compared to the portion of the nose which is displaceable through the valve seat, but preferably the abutment face is closed.

In order to reduce loss of pressurized dispensing fluid around the actuator, it is advantageous to provide a secondary annular seal which slidably engages a cylindrical wall portion of the actuator extending forwardly from adjacent the abutment face in the one embodiment. It has further been found that the trigger pressure may be reduced if the diameter of the secondary annular seal is reduced, and conveniently the portion of the passage extending through the cylindrical exterior wall of the actuator is of reduce diameter compared to the portion of the passage forwardly thereof. This enables the cylindrical exterior wall to be of relatively reduced diameter and the secondary annular seal to be of correspondingly reduced diameter. The secondary, annular seal may have substantially same diameter as the valve seat.

Two embodiments of a fluid dispensing nozzle in accordance with the invention will now be described by way of example only with reference to the accompanying drawings.

DETAILED DESCRIPTION OF THE PREFERRED EMBODIMENT

Figure 1:
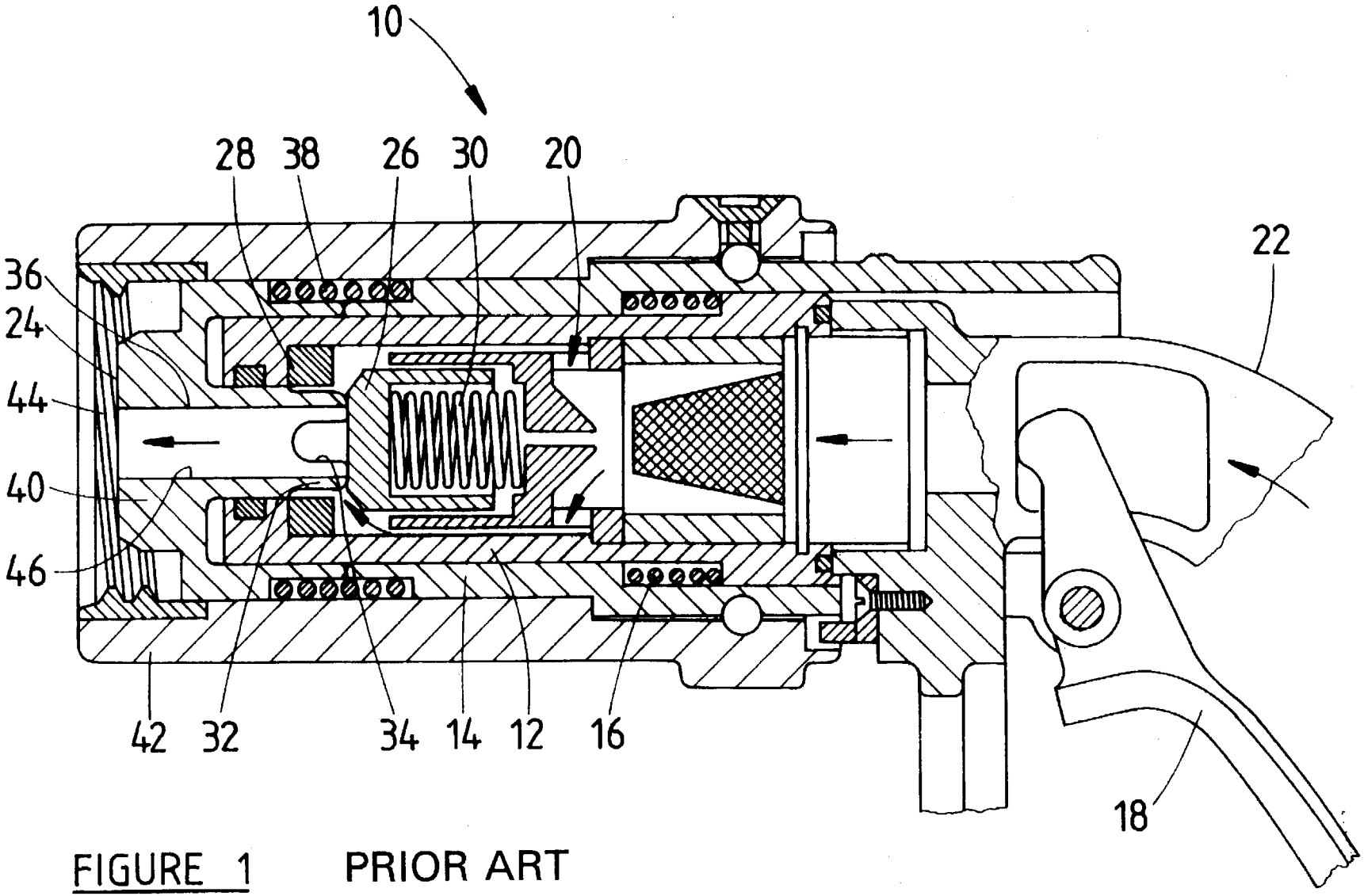
FIGURE 1 PRIOR ART
FIG. 1 is a partial side view, partly in section, of the prior art nozzle of AU-A-79191/87 showing the nozzle in a fluid-dispensing mode of operation.

The LPG dispensing nozzle shown in FIG. 1 is described in detail in AU-A-79191/87.

Briefly, the nozzle 10 comprises a nozzle body 12 which is axially slidably in a slide sleeve 14 against the bias of a compression spring 16 by means of a lever 18. The nozzle body 12 carries valve means shown generally at 20 therein which, when the lever 18 is released, prevents pressurized fluid flow from a hose 22 passing to an outlet end 24 of the nozzle by means of a valve piston 26 which is biased into engagement with a valve seat 28 by a compression spring 30.

The valve means 20 is opened as shown in FIG. 1 when the lever 18 is actuated to displace the nozzle body 12 and valve means 20 axially forwardly relative to the slide sleeve 14 to bring the valve piston 26 into engagement with an actuator 32 to lift the piston valve off the valve seat 28. The pressurized fluid then follows the route shown by the arrows in FIG. 1 through ports 34 (one only shown) in the actuator to the outlet end 24.

The actuator 32 forms part of a hollow seal member 36 which is axially slidable relative to the nozzle body 12 and slide sleeve 14 and is biased away from the slide sleeve 14 by a compression spring 38. When the seal member 36 is in its thus biased condition (not shown in FIG. 1) the actuator 32 is disposed forwardly of the valve seat 28 whereby axial displacement of the nozzle body 12 and valve means 20 by the lever 18 will not cause the valve piston 26 to be lifted from the valve seat 28. The seal member 36 is displaced rearwardly against the bias of spring 38 into the position shown in FIG. 1 by engagement of a nose-piece 40 of the seal member 36 with a cooperating seal face of a vehicle tank inlet (not shown) when the nozzle is coupled to the tank inlet.

Coupling of the nozzle 10 to the tank inlet is effected by a connector 42 which is in the form of a sleeve axially fixed on but rotatable relative to the slide sleeve 14. At the outlet end 24 of the nozzle the connector 42 is provided with a screw-thread 44 on its inner periphery to cooperate with a corresponding screw-thread on the tank inlet.

In use, therefore, LPG cannot be dispensed through the nozzle 10 until the seal member 36 is displaced rearwardly by engagement of the nose-piece 40 with the seal face of the tank inlet. This is effected by screw-threadedly engaging the connector 42 with the tank inlet to bring the forwardly biased seal member 36 into contact with the seal face. Normally the seal face includes a gasket and, if this is present and the connector 42 is fully screw-threadedly engaged with the tank inlet, the seal member 36 is displaced rearwardly to its maximum extent, that is into abutment with the slide sleeve 14. Then, when the lever 18 is actuated, the nozzle body 12 and valve seat 28 will be displaced forwardly so that the actuator 32 projects through the valve seat and lifts the valve piston 26 off the seat 28. Pressurized LPG then flows through the passage 46 defined by the hollow seal member 36 by way of the ports 34 to the outlet end 24.

The passage 46 through the hollow seal member 36 in AU-A-79191/87 extends axially from one end to the other and the abutment face which engages the valve piston 26 is annular. Since the valve seat 28 must extend around the annular wall of the actuator 32 the cross-sectional area of the valve seat 28 is predetermined In order to reduce the required trigger force in the nozzle 10, the valve means 20 comprises a dashpot system formed by the valve piston 26 and a cylinder 48 against which the spring 30 acts. The pressure within the dashpot is normally set by flow of LPG from the hose 22 through a bleed hole 50 on the axis of the cylinder 48. When the valve piston 26 is lifted from the seat 28, the pressure in the dashpot chamber is reduced by leakage through an annular gap 52 between the piston 26 and cylinder 48 to ease further opening of the valve on further movement of the lever 18. The reduction in pressure in the dashpot chamber arises because the LPG escapes through the annular gap 52 faster than it enters through the bleed hole 50. While the trigger force needed to fully open the valve means 20 may be reduced overall by the described dashpot system, the initial trigger force is not reduced at all.

Furthermore, if in AU-A-79191/87 the gasket in the tank inlet is missing and/or the connector 42 is not filly engaged with the tank inlet, for example because of a cross-threaded engagement or because it becomes loose during use, the seal member 36 will not be fully rearwardly displaced yet may be sufficiently rearwardly displaced that when the lever 18 is actuated, the actuator 32 will at least partly lift the valve piston 26 off the seat 28. Pressurized LPG then flowing through the passage 46 in the seal member 36 to the outlet end 24 may under these circumstances cause the seal member 36 to lift off the seal face of the tank inlet allowing LPG leakage. Complete screw-threaded engagement of the nozzle 10 may in practice be achieved with only about a one-half rotation of the connector 42 and relatively small degrees of counter rotation may permit leakage of the pressurized fuel. Such leakage may even be from under the gasket if it is provided and the connector is not fully engaged with the tank inlet.

Figure 2:
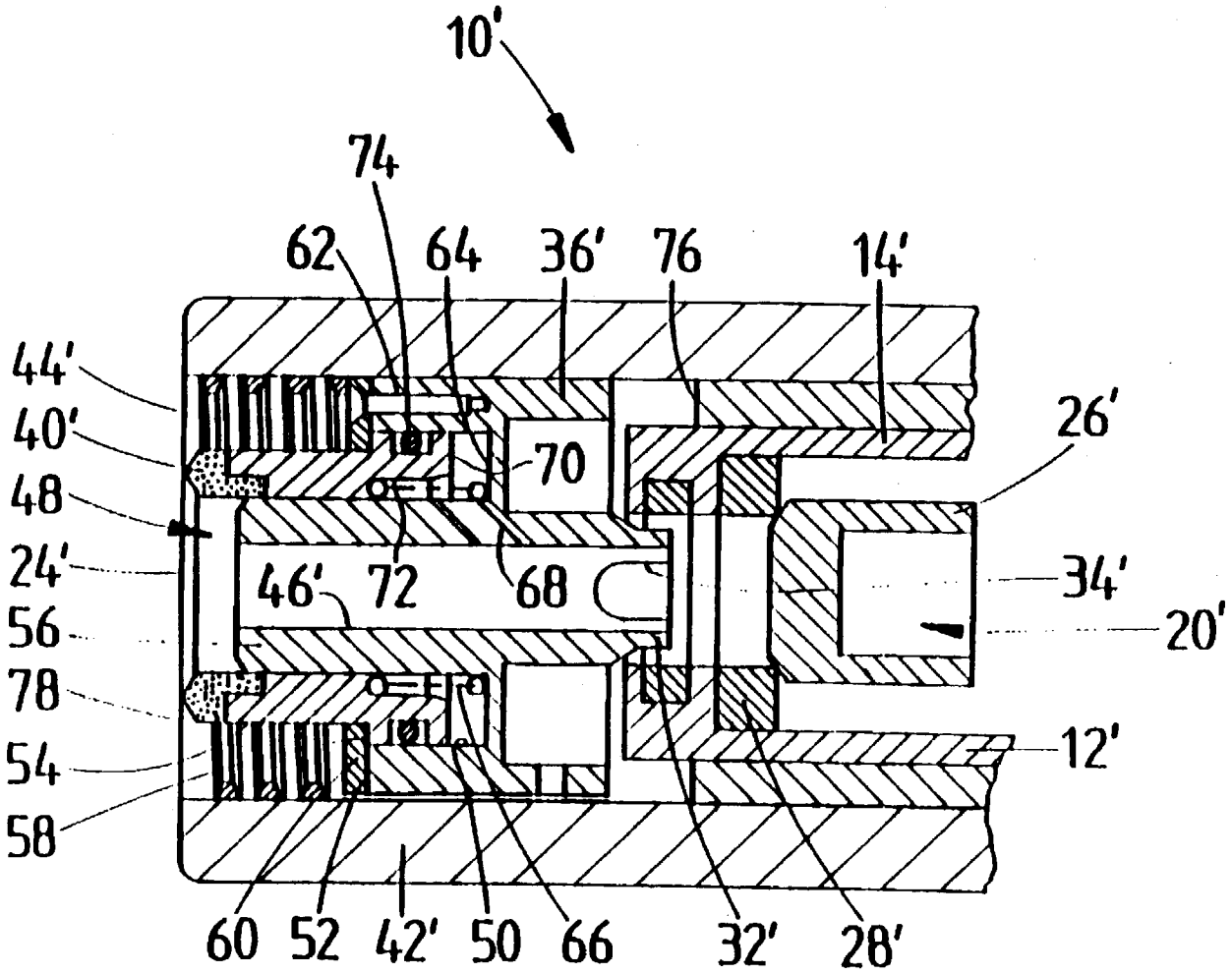
FIG. 2 shows part of FIG. 1 but with the nozzle modified in accordance with a first embodiment of the present invention and in a non-operational mode.

Referring now to FIG. 2, the same or similar parts to those in FIG. 1 will be given the same name and reference numeral followed by a prime. Only the forward end of the nozzle 10' differs from the nozzle 10 and the valve opening and closing is performed in exactly the same manner. Accordingly, only the different features will be described.

FIG. 2 illustrates the nozzle 10' in a condition in which it is disengaged from a tank inlet and the lever (not shown) has not been actuated to shift the nozzle body 12' and valve assembly 20' axially forwardly (to the left in FIG. 2). Thus, the valve piston 26' is engaged with the valve seat 28' with the nozzle body 12' and valve assembly 20' in their axially rearwardmost condition, and a sealing assembly 48 comprising a seal member 36' and a nose-piece 40' is in its axially forwardmost condition.

The seal member 36' and forward portion of the connector 42' have been axially extended compared to the corresponding parts of nozzle 10, and annular recess or chamber 50 formed in a forwardly facing face 52 of the seal member 36'. A sleeve 54, which is moulded in acetal resin and carries the nose-piece 40' at its forward end is slidably mounted about an inner tubular portion 56 of the seal member 36' and partly received in the annular recess 50. The sealing sleeve 54 has an enlarged diameter at its rearward end to define a shoulder 58. Axially forwards displacement of the sealing sleeve 54 in the recess 50 is limited by a retaining ring 60 engaging the shoulder 58. The retaining ring 60 is secured to the face 52 of the seal member 36' by a plurality of screw fasteners 62 (one only shown). Rearwards axial displacement of the sealing sleeve 54 is limited by the end face 64 of the recess 50. A compression spring 66 biases the sealing sleeve 54 away from the recess end face 64 and into contact with the retaining ring 60 when no other forces apply. However, a plurality of ports 68 (one only shown) extends through the inner tubular portion 56 of the seal member 36' from the passage 46' into the recess 50, adjacent the recess end face 64, to supply pressurized fluid passing through the passage 46' to the recess 50 when the valve assembly 20' is open. The pressurized fluid acts on the end face 70 of the sleeve 54 to drive the shoulder 58 of the sleeve towards the retaining ring 60. Since the compression spring 66 is received in an annular rebate 72 in the radially inner surface of the sleeve 54, pressurized fluid can enter the recess 50 even when the sleeve 54 is in a rearwardmost condition as may occur when the nozzle 10' is fully coupled to a tank inlet. An O-ring seal 74 fitted in a recess in the outer diameter of the sleeve 54 within the recess 50 of the seal member 36' contains the fluid pressure within the recess 50. In an alternative embodiment fluid pressure could be supplied to the recess 50 from around the forward end of the tubular portion 56 and between the seal member 36' and the sleeve 54 so that the ports 68 may be omitted.

The resilient nose-piece 40' is formed, for example by machining or moulding, in polyurethane or thermoplastic polyester and may be snap engaged or bonded to the sleeve 54. It has a smaller cross-sectional area than the pressure-receiving face 70 of the sleeve 54 to alleviate any risk of the pressurized fluid passing through the outlet end lifting the nose-piece 40' from the tank inlet seal face. The spring 66 causes a preload to be applied to the seal face of the tank inlet by the nose-piece 40'.

In the disengaged condition of the nozzle 10', the seal member 36' is axially free-floating between a rearwardmost position in which it engages the forwards most face 76 of the slide sleeve 14' (as in the nozzle 10 shown in FIG. 1 except that no biasing spring 38 is provided) and a forwardmost position in which the retaining ring 60 abuts the closest part of the screw-thread 44'. Compared to the nozzle 10, the screw-thread 44' has an increased number of turns so as to ensure that, with an appropriate tank inlet, the connector may be rotated by one and a half to two full turns in order to fully engage it with the tank inlet.

The nose-piece 40' and sleeve 54 of the nozzle 10' are of smaller diameter than the nose-piece 40 of the nozzle 10 so that for the same tank inlet, if the engagement of the nozzle with the tank inlet is cross-threaded, the nose-piece 40' and sleeve 54 are less likely to bind on the tank inlet. Thus there is an increased radial spacing between the screw-thread 44' and sleeve 54 in the nozzle 10' than between the nose-piece 40 and screw-thread 44 in the nozzle 10. By this arrangement, the sealing assembly 48 is less likely to be urged rearwardly by a side face of the tank inlet engaging the nose-piece 40' or sleeve 54.

In operation, the nozzle 10' is aligned with the tank inlet and screw-threadedly engaged therewith. As the nozzle is screw-threadedly engaged, the nose-piece 40' engages the seal face and the axially rearwardly directed force from such engagement is directed with increased screw-threaded engagement through the sleeve 54, and through the spring 66 to the seal member 36'. The seal member 36' is urged rearwardly until it abuts the face 76 of the slide sleeve 14' whereupon further rearwards displacement of the sealing assembly 48 caused by continued screw-threaded engagement is taken up by the spring 66 as the sleeve 54 is displaced rearwardly in the recess 50. The connector 42' is fully engaged with the tank inlet after about one and a half complete turns at which stage the sleeve 54 will have been displaced rearwardly dose to the face 64 of the recess 50. At this stage the actuator 32' carried by the seal member 56' has been displaced rearwardly close to the valve piston 26', and the valve 20' can be opened by manipulation of the lever (not shown, 18 in FIG. 1) to axially forwardly displace the nozzle body 12' and valve 20' so that the valve body 26' is lifted off the valve seat 28' by the actuator. The pressurized fluid thus passes over the valve seat 28' and into the passage 46' through the ports 34'. Part of the pressurized fluid is diverted through the ports 68 into the recess 50 where it drives the sleeve 54 (which is preloaded by the spring 66) axially forwardly to compress the resilient nose-piece 40' against the seal face of the tank inlet. Ensuring that a clamping force is applied through the sleeve 54 to a gasket defining the seal face of the tank inlet when the fluid pressure reaches the gasket reduces the possibility of fluid pressure lifting the gasket from its mounting surface and therefore allowing a leak path to develop before sealing is achieved. The described arrangement also allows a leak-free connection with the tank inlet and full pressurized fluid flow even if the connector is not fully engaged with the tank inlet or if the gasket is missing since the nosepiece can nevertheless be displaced sufficiently forwardly to make a seal with the seal face.

Figure 3:
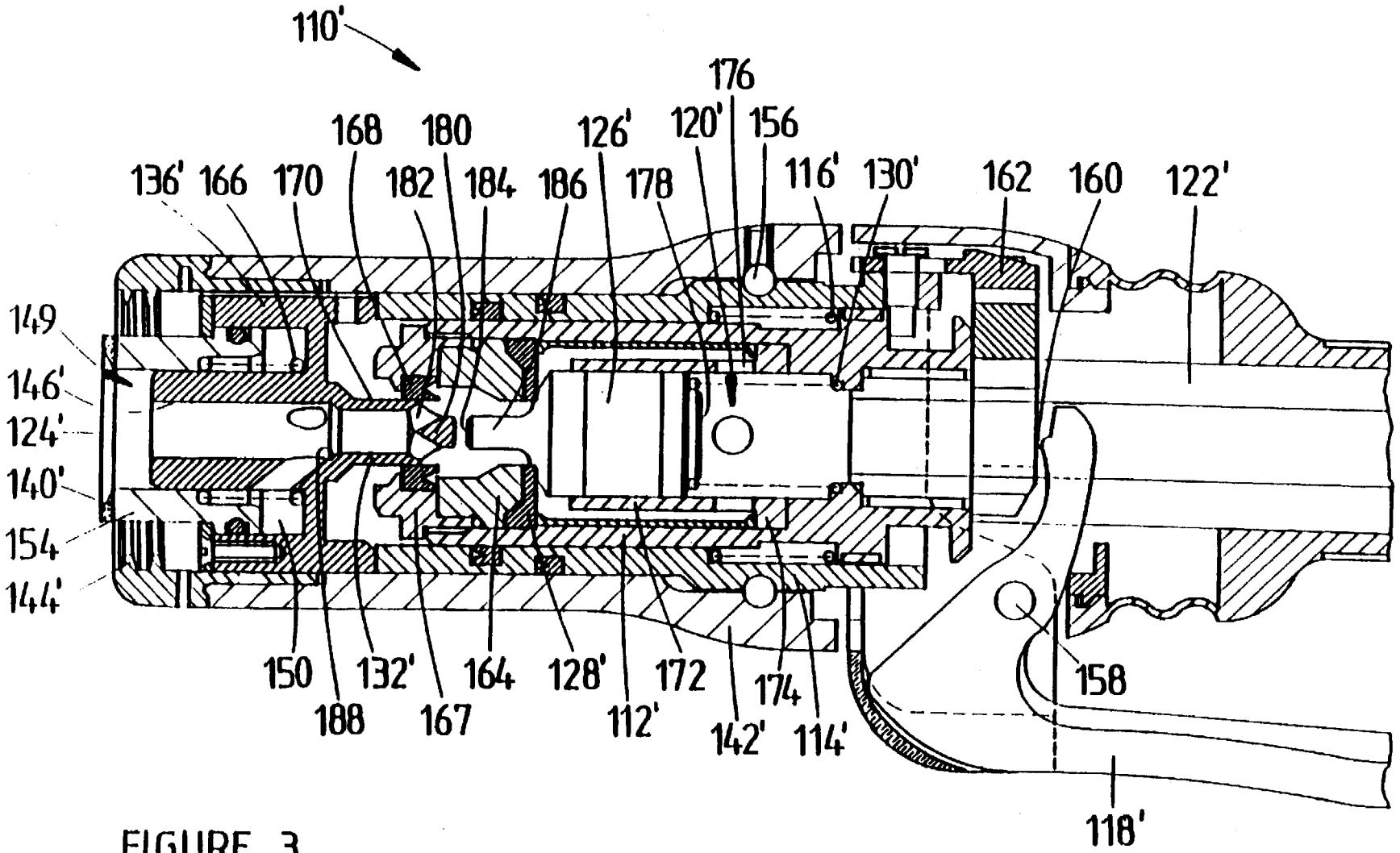
FIG. 3 is a sectional side view of a second embodiment of nozzle in accordance with the invention, also in non-operation mode.
Figure 4:
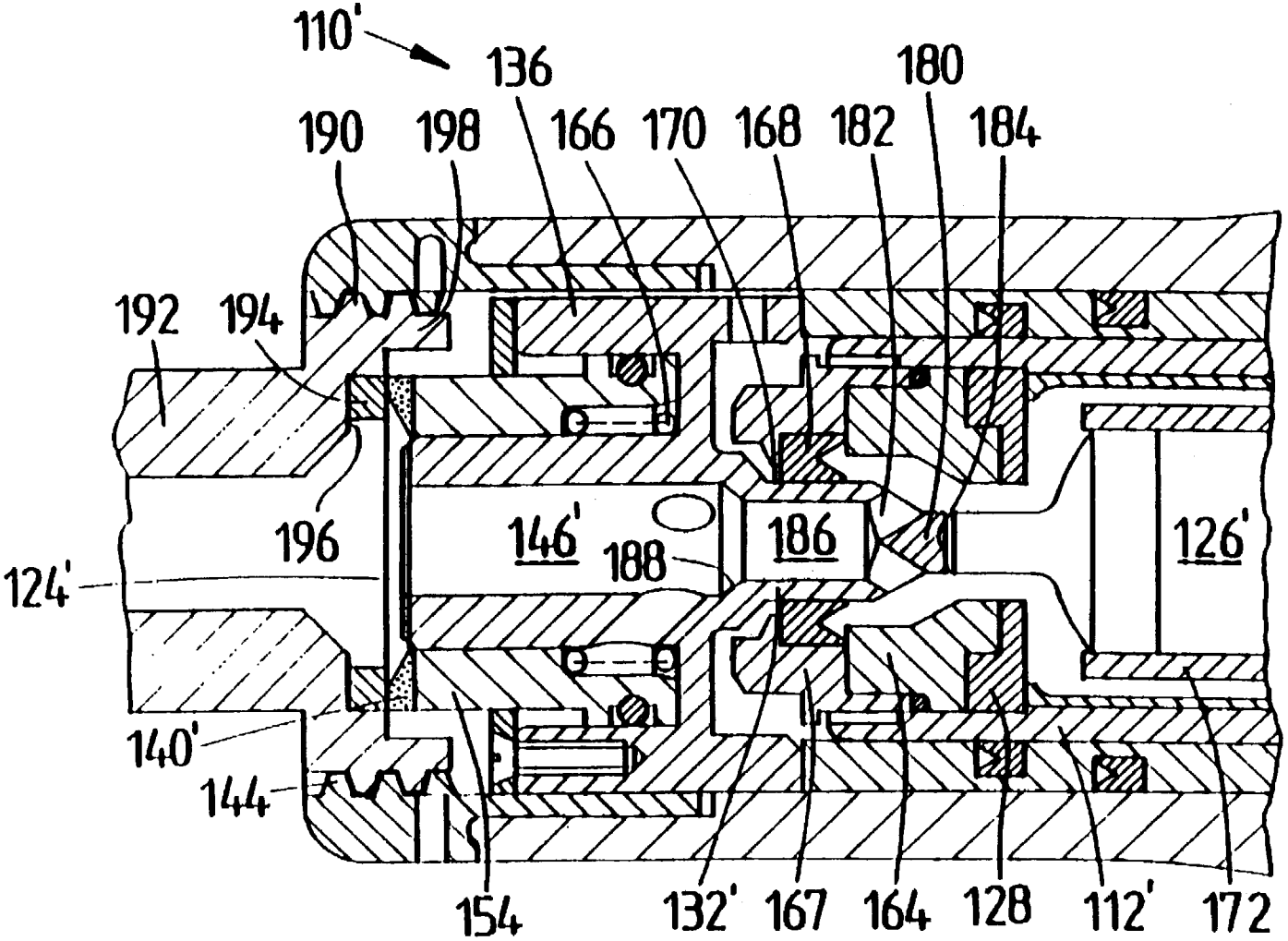
FIG. 4 is an enlargement of the forward part of FIG. 3 but showing the nozzle connected to a tank inlet and the valve open.

Referring now to FIGS. 3 and 4, the same or similar parts to those in FIGS. 1 and 2 will be given the same name and reference numeral, preceded by a "1" and followed by a prime, as appropriate. Not all of the numbered parts are necessarily described with reference to FIGS. 3 and 4 but are described with reference to FIGS. 1 or 2 and perform the same function.

FIG. 3 illustrates the nozzle 110' in a condition in which it is disengaged from a tank inlet (shown in FIG. 4) and the lever 118' has not been actuated to shift the nozzle body 112' and valve assembly 120' axially forwardly. Thus, the valve body 126' is engaged with the valve seat 128' with the nozzle body 112' and valve assembly 120' in their axially rearwardmost condition. A seal member 136' of a sealing assembly 149 is shown displaced to its axially rearwardmost condition in engagement with the slide sleeve 114' but is free to float between that position and a forwardmost position in which it abuts a screw thread 144' on the connector 142', as shown for example in FIG. 2.

The sealing assembly 149 also comprises a sealing sleeve 154 carrying the nose-piece 140' and is substantially the same as, and operates as described with reference to, the sealing assembly 48 fully described in relation to FIG. 2. For convenience, therefore, the sealing assembly 149 herein will not be described further except in so far as it relates to the other aspects of the nozzle 110'.

As with the nozzle 10', the connector 142' is rotatably mounted on the slide sleeve 114' by means of an array of ball bearings 156. The connector 142' is thus rotatable relative to the nozzle as a whole whereby screw-thread 144' at its forwardmost end can engage with a corresponding screw-thread 190 of a tank inlet 192 as shown in FIG. 4 When the connector is fully engaged with the tank inlet, preferably by at least one and a half complete rotations of the connector, the forwardly-biased sealing sleeve 154 is urged rearwardly in the recess 150 with the seal member 136' abutting the end of the slide sleeve 114' as shown. As shown in FIG. 4, the nosepiece 140' engages an annular gasket 194 on a seal face 196 of the tank inlet and the arrangement is such that the sealing sleeve 154 is fully retracted in the recess 150. A bad connection between the nozzle 110' and tank inlet, for example because of a missing gasket 194 or incomplete screw-threaded engagement, is made up for by more or less displacement of the sealing sleeve 154 relative to the seal member 136' against the bias of spring 166 with the seal member 136' in its rearwardmost valve actuating condition. The seal member 136' has an actuator 132' which in this condition is in a position to open the valve assembly 120', as shown in FIG. 4, when the nozzle body 112' and valve assembly 120' are displaced axially forwardly by actuation of the trigger lever 118'. The pressurized fluid entering the recess 150 through the passages 134', when the valve assembly 120' is open, forces the nosepiece 140' firmly against the gasket 194, or against the seal face 196 if the gasket is missing, to ensure an adequate seal between the nozzle and tank inlet.

FIG. 4 also illustrates the radial spacing between the tank inlet mounting flange 198 and the sealing sleeve 154 which reduces the likelihood of the flange itself preventing the sealing sleeve 154 and nosepiece from making the seal with the tank inlet.

In order to open the valve assembly 120', the trigger lever 118' is pivoted at 158 on an extension of the slide sleeve 114' and manual actuation of the lever causes an abutment surface 160 to axially forwardly displace a cooperating member 162 which is fast with the nozzle body 112' so that the nozzle body is also displaced forwardly against the spring 116'.

The nozzle body 112' carries the valve seat 128', a spacer 164 and a retaining ring 167 which screw-threadedly engages the nozzle body 112' and which supports an annular secondary seal 168. The secondary seal 168 is slidably engaged with the cylindrical external surface 170 of the actuator 132' when the seal member 136 is in its rearwards most condition. The secondary seal 168 alleviates leakage of LPG around the actuator 132 when the valve assembly 120' is open.

The nozzle body 112' also supports for axial displacement therewith a cylinder 172 which, except at its rearwards most end 174, is radially spaced from the nozzle body 112'. The cylinder 172 is hollow and slidably supports the valve body 126' therein in a close manner. However, it is not vital that there be a sealing fit between the valve body 126' and the cylinder 172 since LPG within the cylinder 172 is in open communication with the leading end of the valve body, at least up to where it engages the valve seat 128', by way of opening 176 through the cylinder 172 and the annular gap between the cylinder 172 and the nozzle body 112'.

The interior of the cylinder 172 is permanently in communication with LPG received from the hose 122' and this fluid pressure acts directly on the end face 178 of the valve body 126' to normally maintain the nozzle body 126' in sealing contact with the valve seat 128' and therefore also to carry the valve body 126' forwardly with the nozzle body 112'. The compression spring 130' is provided to ensure closure of the valve assembly 120' when the trigger pressure is released.

As the valve body 126' is displaced axially forwardly with the nozzle body 112' by actuating the trigger lever 118', the nozzle body engages an abutment face 180 of the rearwardly displaced actuator 132'. The abutment face 180 is co-axial with the valve seat 128'. This engagement lifts the valve body 126' off the valve seat 128' to open the valve assembly. The abutment face 180 is co-axial with the seal member 136' and partially closes the passage 146' therethrough at the actuator end of the seal member, with opening 182 to the passage 146' at said end being disposed radially outwardly of the abutment face 180. The openings 182 are provided in a face of the actuator which tapers from the cylindrical surface 170 to the abutment face 180. Thus, the abutment face 180 has a considerably smaller cross-sectional area than the portion of the actuator defined by the cylindrical surface 170 which ensures that a smaller surface of the valve body 126' is engaged by the abutment face. This reduced contact area with the valve body enables the valve seat 128' to have a smaller diameter, that is the diameter of the annulus defined by the valve seat, which directly reduces the trigger pressure as the valve assembly 120' is opened by actuating the lever 118'.

Engagement of the abutment face 180 is with an end face 184 of a forwardly projecting nose 186 of the valve body 126', the nose having a sufficient length that it projects through the valve seat 128' both in the open and closed conditions of the valve means 120'. The end face 184 has substantially the same surface area as the abutment face 180 of the actuator 132'.

The nose 186 is of a sufficiently smaller diameter than the valve seat 128' to allow adequate dispensing fluid flow through the valve seat when the valve means is open.

It has also been found that the trigger pressure is a direct function of the diameter of the secondary seal 168 and, to enable a reduction in its diameter, the portion of the passage 146' extending within the cylindrical portion 170 of the actuator 132' is stepped radially inwardly at 188 which permits the external diameter of the cylindrical portion 170 to be relatively reduced. As shown, the reduced diameter secondary seal may have substantially the same diameter as the valve seat 128'.

It will be appreciated that instead of providing the nose 186 on the valve body 126', the abutment face 180 of the actuator 132' may be provided on a corresponding tail of the actuator.

The nozzles 10' and 110' may incorporate a connector locking device of a type described in Australian Patent No. 671766 in the name of the assignee.

Those skilled in the art will appreciate that the invention described herein is susceptible to variations and modifications other than those specifically described. It is to be understood that the invention includes all such variations and modifications which fall within the its spirit and scope. The invention also includes all of the steps and features referred to or indicated in this specification, individually or collectively, and any and all combinations of any two or more of said steps or features. The invention is particularly applicable for use with LPG nozzles which are to be connected to vehicle tanks, especially car LPG tanks at service stations. However, the invention is also suitable for use with, for example, nozzles which are used to connect LPG and other pressurized fluid delivery trucks with storage tanks and it will be understood that the tank inlet may be at an upstream end of a hose or pipe connected or connectable to a tank.

What is claimed is:

1. A pressurized fluid dispensing nozzle comprising a connector for coupling the nozzle to a tank inlet which connector is adapted to contact said tank inlet, a valve for controlling the dispensing flow of fluid through the nozzle in a forward generally axial direction, a sealing nose-piece which is engageable with a seal face of the tank inlet for providing a seal between the nozzle and the tank inlet when the nozzle is coupled to the tank inlet and a valve actuator which is displaceable rearwardly towards a valve actuating condition by engagement of the sealing nose-piece with the seal face of the tank inlet, the sealing nose-piece being provided on a sealing sleeve through which the fluid is dispensed to an outlet end of the nozzle defined by said nose-piece, the sealing sleeve being axially displaceable in opposed directions relative to the connector and to the valve actuator, and wherein axial displacement of the sealing sleeve in the forward direction is actuated by the dispensing flow of pressurized fluid through the nozzle when the valve is open whereby when the nozzle is coupled to the tank inlet the nose-piece is driven by the pressurized fluid into engagement with said seal face.

2. A pressurized fluid dispensing nozzle according to claim 1 wherein the sealing sleeve is mounted for limited axial displacement on a seal member having a passage extending generally axially therethrough through which the dispensing flow of fluid passes to the outlet end of the nozzle.

3. A pressurized fluid dispensing nozzle according to claim 2 wherein the seal member is permitted limited axial displacement.

4. A pressurized fluid dispensing nozzle according to claim 3 wherein the valve actuator projects rearwardly from the seal member.

5. A pressurized fluid dispensing nozzle according to claim 4 wherein the valve comprises an annular valve seat and a valve body axially displaceable relative to the seat, the actuator is capable of abutting the valve body to open the valve, the passage through the seal member extends through the actuator, and an operating device is provided for opening the valve by displacing the valve into a position in which the actuator is adapted to abut the valve body.

6. A pressurized fluid dispensing nozzle according to claim 5 wherein the actuator has an abutment face for engagement with the valve body which is substantially co-axial with the valve seat and is closed to the passage and the passage opens through a wall of the actuator adjacent said abutment face.

7. A pressurized fluid dispensing nozzle according to claim 6 wherein the passage has plural openings adjacent the abutment face of the actuator.

8. A pressurized fluid dispensing nozzle according to claim 6 wherein each face of the wall of the actuator through which the passage opens adjacent the abutment face of the actuator tapers towards said abutment face.

9. A pressurized fluid dispensing nozzle according to claim 6 wherein the actuator is adapted to abut a nose of the valve body which projects through the valve seat.

10. A pressurized fluid dispensing nozzle according to claim 5 wherein the valve body is provided with a nose for engagement with the actuator which projects forwardly of the valve seat in both the open and closed conditions of the valve and wherein the portion of the nose which is displaceable through the valve seat has a cross-sectional area smaller than the valve seat to permit the dispensing flow of fluid through the valve seat.

11. A pressurized fluid dispensing nozzle according to claim 5 wherein the actuator has a cylindrical exterior wall and a secondary seal is in slidable sealing contact with the cylindrical exterior wall, and farther wherein the portion of the passage which extends within said cylindrical exterior wall of the actuator is of smaller diameter than the portion of the passage which extends through the seal member axially forwardly of the actuator.

12. A pressurized fluid dispensing nozzle according to claim 2 wherein a chamber for the pressurized fluid is provided between the sliding sleeve and the seal member, a biasing device is provided for biasing the sliding sleeve in said forward direction, and the sliding sleeve biasing device is provided in the chamber.

13. A pressurized fluid dispensing nozzle according to claim 1 wherein the sealing sleeve is biased in said forward direction by a biasing device.

14. A pressurized fluid dispensing nozzle according to claim 1 wherein the axial displacement of the sealing sleeve in said forward direction is actuated by the pressurized fluid whereby the sleeve is sealingly engaged with the tank inlet when the pressurized fluid reaches the outlet end of the nozzle.

15. A pressurized fluid dispensing nozzle according to claim 1 wherein an actuating surface of the sealing sleeve has a greater area than an end face of the nose-piece.

16. A pressurized fluid dispensing nozzle according to claim 1 wherein the nose-piece is formed of resilient material.

17. A pressurized fluid dispensing nozzle according to claim 1 wherein the connector is screw-threadedly engageable with the tank inlet and the connector screw thread allows about one and a half to two complete rotations of the connector on the tank inlet.

18. A pressurized fluid dispensing nozzle according to claim 1 wherein the connector is screw-threadedly engageable with the tank inlet such that part of the tank inlet is received between the connector and the sealing sleeve and wherein an outer diameter of the sealing sleeve is sufficiently smaller than an inner diameter of the tank inlet that the tank inlet will not bind the sealing sleeve in the event of a cross-threaded engagement.

19. A pressurized fluid dispensing nozzle comprising a connector for coupling the nozzle to a tank inlet, a valve for controlling the dispensing flow of fluid through the nozzle in a forward generally axial direction, a sealing nose-piece which is engageable with a seal face of the tank inlet for providing a seal between the nozzle and the tank inlet when the nozzle is coupled to the tank inlet, and a seal member which is permitted limited axial displacement relative to the connector, the seal member having a passage therethrough for the dispensing flow of fluid and further comprising a rearwardly projecting actuator for opening the valve, the seal member being displaced rearwardly towards a valve actuating condition by engagement of the nose-piece with the seal face of the tank inlet, and wherein the nose-piece is provided on a sealing sleeve which is mounted for limited axial sliding movement on the seal member, axial movement of the sealing sleeve in the forward direction being actuated by the dispensing flow of pressurized fluid through the nozzle when the valve is open whereby when the nozzle is coupled to the tank inlet the nose-piece is driven by the pressurized fluid into engagement with the seal face.

20. A pressurized fluid dispensing nozzle according to claim 19 wherein a chamber for the pressurized fluid is provided between the sliding sleeve and the seal member, a biasing device is provided for biasing the sliding sleeve in said forward direction, and the sliding sleeve biasing device is provided in the chamber.

21. A pressurized fluid dispensing nozzle according to claim 19 wherein the sealing sleeve is biased in said forward direction by a biasing device.

22. A pressurized fluid dispensing nozzle according to claim 19 wherein the axial displacement of the sealing sleeve in said forward direction is actuated by the pressurized fluid whereby the sleeve is sealingly engaged with the tank inlet when the pressurized fluid reaches the outlet end of the nozzle.

23. A pressurized fluid dispensing nozzle according to claim 19 wherein an actuating surface of the sealing sleeve has a greater area than an end face of the nose-piece.

24. A pressurized fluid dispensing nozzle according to claim 19 wherein the nose-piece is formed of resilient material.

25. A pressurized fluid dispensing nozzle according to claim 19 wherein the connector is screw-threadedly engageable with the tank inlet and the connector screw thread allows about one and a half to two complete rotations of the connector on the tank inlet.

26. A pressurized fluid dispensing nozzle according to claim 19 wherein the connector is screw-threadedly engageable with the tank inlet such that part of the tank inlet is received between the connector and the sealing sleeve and wherein an outer diameter of the sealing sleeve is sufficiently smaller than an inner diameter of the tank inlet that the tank inlet will not bind the sealing sleeve in the event of a cross-threaded engagement.

27. A pressurized fluid dispensing nozzle according to claim 19 wherein the valve comprises an annular valve seat and a valve body axially displaceable relative to the seat, the actuator is capable of abutting the valve body to open the valve, the passage through the seal member extends through the actuator, and an operating device is provided for opening the valve by displacing the valve into a position in which the actuator is adapted to abut the valve body.

28. A pressurized fluid dispensing nozzle according to claim 27 wherein the actuator has an abutment face for engagement with the valve body which is substantially co-axial with the valve seat and is closed to the passage and the passage opens through a wall of the actuator adjacent said abutment face.

29. A pressurized fluid dispensing nozzle according to claim 28 wherein the passage has plural openings adjacent the abutment face of the actuator.

30. A pressurized fluid dispensing nozzle according to claim 28 wherein each face of the wall of the actuator through which the passage opens adjacent the abutment face of the actuator tapers towards said abutment face.

31. A pressurized fluid dispensing nozzle according to claim 28 wherein the actuator is adapted to abut a nose of the valve body which projects through the valve seat.

32. A pressurized fluid dispensing nozzle according to claim 27 wherein the valve body is provided with a nose for engagement with the actuator which projects forwardly of the valve seat in both the open and closed conditions of the valve and wherein the portion of the nose which is displaceable through the valve seat has a cross-sectional area smaller than the valve seat to permit the dispensing flow of fluid through the valve seat.

33. A pressurized fluid dispensing nozzle according to claim 27 wherein the actuator has a cylindrical exterior wall and a secondary seal in slidable sealing contact with the cylindrical exterior wall, and further wherein the portion of the passage which extends within the said cylindrical exterior wall of the actuator is of smaller diameter than the portion of the passage which extends through the seal member axially forwardly of the actuator.

* * * * *

UNITED STATES PATENT AND TRADEMARK OFFICE

CERTIFICATE OF CORRECTION

PATENT NO. : 5,725,034
DATED : March 10, 1998
INVENTOR(S) : Fry et al.

It is certified that error appears in the above-indentified patent and that said Letters Patent is hereby corrected as shown below:

On the title page, Item [56] FOREIGN PATENT DOCUMENTS, the list of cited references should include --1190273 4/1959 Germany--.

| | |
|---|---|
| In Column 1, Line 13, | the patent now reads --the trunk inlet--; this should read --the tank inlet--. |
| In Column 3, Line 51, | the patent now reads --valve body have--; this should read --valve body to have--. |
| In Column 3, Line 61, | the patent now reads --projects rewardly-- this should read --projects rearwardly--. |
| In Column 4, Line 53, | the patent now reads --PREFERRED EMBODIMENT--; this should read--PREFERRED EMBODIMENTS--. |
| In Column 5, Line 66, | the patent now reads --is not filly engaged--; this should read --is not fully engaged--. |
| In Column 7, Line 44, | the patent now reads --rearwardly dose to the face--; this should read --reawardly close to the face--. |

Signed and Sealed this

Fourteenth Day of July, 1998

Bruce Lehman

*Attest:*

BRUCE LEHMAN

*Attesting Officer*

*Commissioner of Patents and Trademarks*